US006455751B1

(12) United States Patent
Hoffman et al.

(10) Patent No.: US 6,455,751 B1
(45) Date of Patent: Sep. 24, 2002

(54) OXIDIZER GELS FOR DETOXIFICATION OF CHEMICAL AND BIOLOGICAL AGENTS

(75) Inventors: Dennis M. Hoffman, Livermore; Raymond R. McGuire, Brentwood, both of CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/392,497

(22) Filed: Sep. 9, 1999

Related U.S. Application Data

(60) Provisional application No. 60/122,712, filed on Mar. 3, 1999.

(51) Int. Cl.[7] ..... A62D 3/00

(52) U.S. Cl. ..... 588/200; 252/186.1; 252/186.28; 252/186.43; 252/187.26

(58) Field of Search ..... 588/200, 205, 588/215, 218, 221, 238, 242, 244, 246; 516/110, 111, 112; 252/186.1, 186.28, 186.36, 186.42, 186.43, 187.26

(56) References Cited

U.S. PATENT DOCUMENTS

| | | | | | |
|---|---|---|---|---|---|
| 3,921,394 | A | * | 11/1975 | Tannenbaum | 149/108.2 |
| 4,344,857 | A | | 8/1982 | Shasha et al. | 252/316 |
| 4,450,233 | A | | 5/1984 | Mimura et al. | 435/178 |
| 4,589,341 | A | | 5/1986 | Clark et al. | 102/303 |
| 4,859,377 | A | | 8/1989 | Shasha et al. | 264/4.1 |
| 4,949,641 | A | | 8/1990 | Sayles | 102/293 |
| 5,230,833 | A | * | 7/1993 | Romberger et al. | 252/363.5 |
| 5,584,071 | A | | 12/1996 | Kalyon et al. | 588/200 |
| 5,678,243 | A | | 10/1997 | Yang et al. | 588/200 |
| 5,710,358 | A | | 1/1998 | Yang et al. | 588/200 |
| 5,763,737 | A | | 6/1998 | Yang et al. | 588/218 |
| 5,770,095 | A | * | 6/1998 | Ssaki et al. | 216/38 |
| 5,864,767 | A | | 1/1999 | Drumgoole et al. | 588/202 |
| 6,096,283 | A | * | 8/2000 | Cooper et al. | 423/437.1 |

FOREIGN PATENT DOCUMENTS

| | | | | |
|---|---|---|---|---|
| DE | 3625583 | * | 6/1988 | 588/200 |
| DE | 2828735 | * | 11/1992 | 588/200 |
| DE | 4114560 | * | 11/1992 | 588/200 |

OTHER PUBLICATIONS

Hammer et al., *Water and Wastewater Technology, Third Edition*. New Jersey, Prentice Hall, Inc. , 1996. p. 252.*

* cited by examiner

*Primary Examiner*—Stanley S. Silverman
*Assistant Examiner*—Eileen E. Nave
(74) *Attorney, Agent, or Firm*—Ann M. Lee; Alan H. Thompson

(57) ABSTRACT

A gel composition containing oxidizing agents and thickening or gelling agents is used to detoxify chemical and biological agents by application directly to a contaminated area. The gelling agent is a colloidal material, such as silica, alumina, or alumino-silicate clays, which forms a viscous gel that does not flow when applied to tilted or contoured surfaces. Aqueous or organic solutions of oxidizing agents can be readily gelled with less than about 30% colloidal material. Gel preparation is simple and suitable for field implementation, as the gels can be prepared at the site of decontamination and applied quickly and uniformly over an area by a sprayer. After decontamination, the residue can be washed away or vacuumed up for disposal.

23 Claims, 4 Drawing Sheets

OXIDIZER GELS FOR DETOXIFICATION OF CHEMICAL AND BIOLOGICAL AGENTS

This patent application claims the benefit of priority of U.S. Provisional Patent Application Serial No. 60/122,712, filed Mar. 3, 1999.

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

This invention relates to oxidizer gels for detoxifying toxic chemical or biological agents on site in the field.

2. Description of Related Art

The possibility of accidental releases or terrorist attacks with chemical or biological weapons has received increased attention. Methods for containing and countering the release of chemical and biological warfare agents are important for public health and safety, as well as national security. If a release occurs, the chemical or biological agents must be immobilized and neutralized or detoxified. Various methods have been developed to chemically detoxify agents such as nerve gases, mustard gas, or microorganisms like Anthrax. These methods, however, are not completely effective on all chemical and biological agents, are highly corrosive so that collateral damage is considerable, or require considerable time for reaction.

U.S. Pat. No. 5,678,243 to Yang et al. discloses a process for detoxification of chemical warfare agent VX and its analogs by hydrolysis. The hydrolysis takes place in the storage container over a period of weeks.

U.S. Pat. No. 5,710, 358 to Yang et al. discloses a process for detoxification of chemical warfare agents phosphonothiolates by reacting with a compound containing $HSO_5$- ion, such as potassium monopersulfate. The reaction products are then hydrolyzed.

U.S. Pat. No. 5,763,737 to Yang et al. discloses a method for reducing the toxicity of methylphosphonothioate ions with hydrogen peroxide and a strong inorganic acid. The reaction is run over a number of days.

A method to detoxify mustard gases is disclosed in U.S. Pat. No. 4,949,641 to Sayles, which involves an initial reaction with a metallic powder and a subsequent deflagration reaction, or thermal pyrolysis.

Other methods to deal with toxic chemical and biological agents involve encapsulation and removal from a site for disposal. U.S. Pat. No. 5,584,071 to Kalyon et al. is a disposal method for highly toxic chemicals in which the chemicals are first neutralized and then encapsulated in a polymeric material. The neutralized, encapsulated products are then transported to a disposal site, where they can be incinerated or buried in a landfill.

Methods of immobilizing microorganisms are disclosed in U.S. Pat. No. 4,4,50,233 to Mimura et al. (using a polymer gel), and in U.S. Pat. No. 4,859,377 to Shasha et al. (using a starch matrix). A method for encapsulating chemical biological agents in a polymer matrix is disclosed in U.S. Pat. No. 4,344,857 to Shasha et al.

These methods are not practical for detoxifying a toxic substance quickly on site in a field situation. A need exists for a substance that can be applied directly to a contaminated area to destroy or detoxify the chemical or biological agents, which can then be washed, swept, or vacuumed away. In addition, the substance must be capable of being effectively applied to any surface or item. The substance must be fluid enough to be quickly and easily applied to surfaces, while viscous enough to adhere to angled or contoured surfaces. Such rheological properties may be achieved by the use of thickening agents.

Thickeners must be chemically compatible with the detoxification agents, such as oxidizing agents, in the substance. Unfortunately, foams and other conventional thickeners, such as those used in paints ($TiO_2$), tend to be incompatible with oxidizing agents and are oxidized along with the targeted biological and chemical agents. Thus, a need exists for a detoxification substance that can be used anywhere in the field under emergency situations that contains thickening agents that are compatible with the oxidizing agents in the substance used to destroy the biological and chemical agents. This invention addresses the above-mentioned problems and provides an oxidizing gel having strong oxidizers and thickening agents that are compatible with the oxidizers.

SUMMARY OF THE INVENTION

The present invention provides a gel composition having oxidizing agents that act on the chemical and biological agents and thickening or gelling agents that are compatible with the oxidizing agents. It is an object of the invention to provide a method for decontaminating an area or items exposed to toxic chemical and biological agents, such as nerve gases, mustard gas, or Anthrax. It is also an object of the invention to provide a detoxification composition having a viscosity that can be applied on any contaminated surface. The rheological properties (i.e., flow) of the composition are such that the gel can be conveniently applied (e.g., sprayed or spread) on the contaminated area on site in the field.

The present composition has thickening or gelling agents made of refractory oxides, such as silica (fumed or precipitated), alumina, or alumino silicate clays. The oxides are in the form of colloidal solids, which form a gel when mixed with a solvent. The solvent can be water or an organic solvent. The oxides are compatible with the oxidizing agents used to oxidize the biological and chemical agents. Suitable oxidizing agents include hydrogen peroxide, potassium permanganate, sodium hypochlorite, potassium peroxymonosulfate, ammonium persulfate, peroxydisulfate, ozone, and ammonium peroxymonosulfate. A solution of the oxidizing agent(s) is mixed with the colloidal solids to form a gel. The viscosity of the gel depends on the concentration of colloidal solids; typically the concentration of solids is in the range of about 3–20% by weight.

The thixotropic and anti-sag characteristics of the gel allow greater concentrations of the oxidizing agent to be in contact with the chemical or biological agents. More uniform coverage of the exposed surfaces is achieved because of the colloidal attraction between the gelling particles. The gel can be applied to floors, walls, ceilings, and other localized sites for detoxification of open or closed areas, or recovery of equipment exposed to the harmful agents. The gel can reach otherwise inaccessible or hidden areas, such as cracks and ductwork. The gel can be applied by simplex or air assisted sprayers, rollers, brushes, or other techniques. Sprayers can apply the gel quickly for emergency applications.

The chemical and biological agents are entrained in the weak gel structure and are destroyed or detoxified by oxidation. The "spent" gel, wet or dry, can be washed away with water or other solutions, or removed by vacuum. The carrier solvent in the gel will evaporate over time, leaving behind a residue that can be vacuumed or swept up. The residue may be analyzed and disposed of as hazardous waste as needed.

Other objects, features, and advantages of the present invention will become apparent from the following description and accompanying drawings.

BRIEF DESCRIPTION OF THE DRAWINGS

The accompanying drawings, which are incorporated into and form part of this disclosure, illustrate embodiments of the invention and together with the description, serve to explain the principles of the invention.

DETAILED DESCRIPTION OF THE INVENTION

Figure 1:
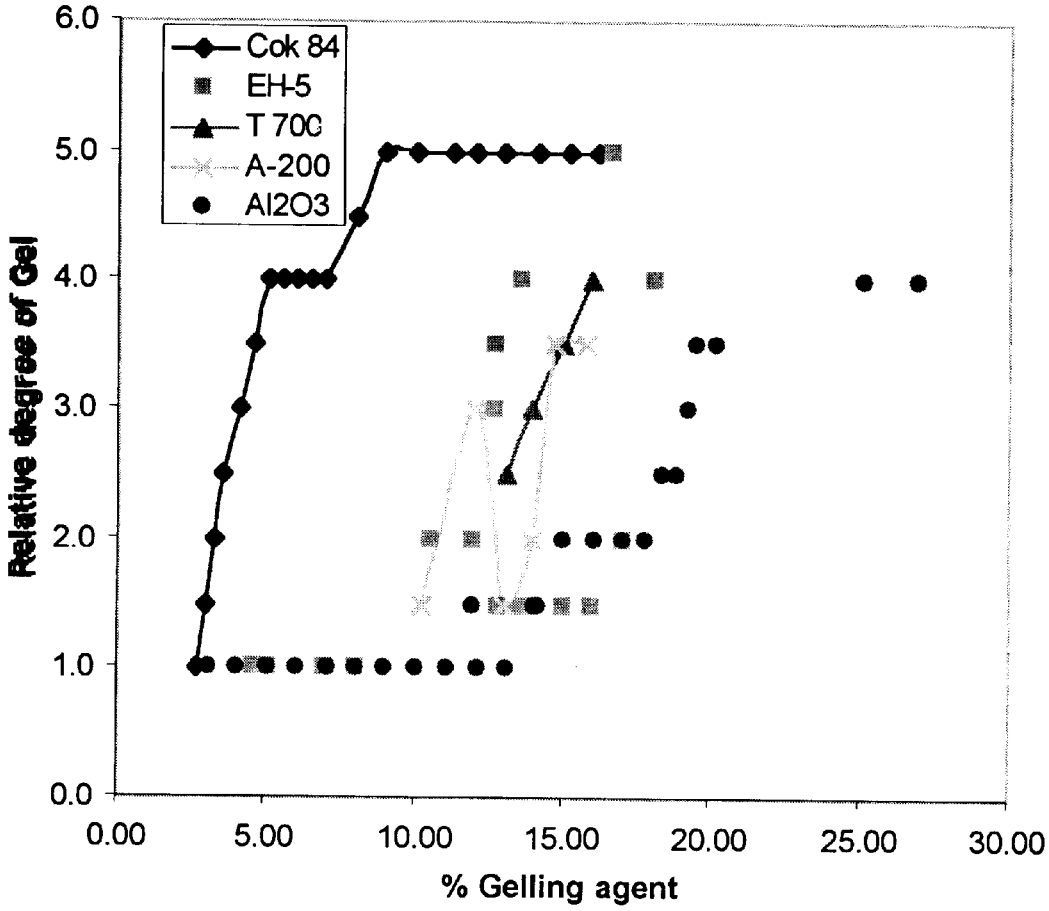
FIG. 1 shows the degree of gelation for various gelling agents in water.

The present invention is a gel composition containing oxidizing agents for detoxifying chemical and biological agents. The gel is sprayable or spreadable and can be applied directly to a contaminated area on site in the field. A gelling or thickening agent in the form of colloids is added to an oxidizer solution to produce a viscous colloidal gel that does not flow when applied to tilted surfaces. Aqueous or organic solutions of the oxidizers or oxidizing agents can be readily gelled with less than about 20% colloidal solids. The gel preparation is simple and suitable for field implementation, as the gels can be prepared at the site of decontamination.

Colloids are fine-grained particles in suspension in a carrier liquid. Colloids exhibit certain properties because of the extremely high surface area of the small particles. Colloidal particles aggregate and form reversible gels that are thicker or more viscous with increasing colloid concentration. The process of gelation is the formation of a three-dimensional network of chains connected at cross-link sites, with a solution trapped between the chains in the network. Colloidal gels have low to moderate stiffness (modulus) as long as the network structure is maintained, which prevents flow or sagging. Under shear forces, this weak network is temporarily destroyed, which allows the gels to be sprayed, spread, or painted onto a surface, and then to re-gel rather than flow off the surface. The gels are thixotropic and thus become fluid when shaken; because the process is reversible, the gel re-forms when settled or undisturbed.

Suitable colloidal materials include silica (fumed or precipitated), alumina, aluminum silicon oxides, mixtures of silica and alumina, and clays such as smectite. Smectite, or montmorillonite, is a group of clay minerals (hydrous alumino-silicate minerals) that are characterized by swelling in water and extreme colloidal behavior. The minerals have the general chemical formula $Al_2Si_4O_{10}(OH)_2$, and ions such as sodium (Na), calcium (Ca), and magnesium (Mg) can be substituted for the aluminum. Colloidal gels based on fumed or precipitated silica are stable against oxidation at low pH, but not in basic media (pH>12). Colloidal gelling agents based on alumina or clays are stable in basic media. The gelling agents form gels with water and organic solutions at low to moderate concentrations. Commercial silica and alumina gelling agents are most successfully gelled at concentrations of about 5–15% (gelling agent by weight), but can be gelled at concentrations as low as 3–4%. Other gelling agents may require higher concentrations over 20% to 30% or more.

The choice of colloidal materials is advantageous for many reasons. The resulting gels are thixotropic, and tend not to sag or flow down walls or off ceilings, which increases the concentration of oxidizing agent to the area where it can be effective. The colloidal materials are naturally abundant and commercially available, and therefore do not require any special facility to prepare. The inert characteristics of these particles compared to carbon blacks or other colloidal particles allows them to survive in the strong oxidant solutions used for decontamination of the various chemical and biological agents.

The oxidizing agents in the gel oxidize elements in the toxic chemical or biological agents, such as the sulfur in mustard gases or VX agents, and the carbon in biological agents, thereby detoxifying them. G agents are detoxified by hydrolysis, which, in an acid medium, is catalyzed by the active surface of the gelling agent. Typical oxidizing agents include sodium hypochlorite, potassium peroxymonosulfate, ammonium persulfate, ammonium peroxymonosulfate, peroxydisulfate, potassium permanganate, and hydrogen peroxide (30%). Potassium peroxymonosulfate ($2KHSO_5KHSO_4K_2SO_4$) solution (1 N) is commercially available as oxone (DuPont Company). A gas phase oxidizing agent such as ozone may be used. A source of metal ions, such as copper or iron, may be added to some oxidizer solutions in small amounts (e.g., 10 ppm) to serve as an oxidation catalyst.

The choice of oxidizing agent may depend on the chemical or biological agent to be targeted. The concentration of the oxidizing agent can be varied depending on different factors, including how quickly detoxification is needed and in the case of biological agents, the concentration needed to ensure 100% lethality. High concentrations of hydrogen peroxide tend to decompose, generating oxygen, and must be prepared just prior to use. Other oxidizer solutions appear to be quite stable. The gels may "crape harden", or thicken slowly with time, so it is advisable to prepare or reconstitute them just prior to use. The oxidizer solution is typically prepared first, and the gelling agent added. Oxidizing solutions that are highly acidic (pH<3) or highly basic (pH>12) are preferred.

Biological agents that can be targeted using the present invention include any type of microorganisms, such as bacteria, fungi, yeasts, viruses, microsporidians (spores), protozoa, and phages. Chemical agents include nerve gases such as ethyl-N,N dimethyl phosphoramino cyanidate, (common name Tabun or agent GA), isopropyl methyl phosphonofluoridate (common name Sarin or agent GB), O-ethyl-S-(2-diisopropylamino)ethyl methyl phosphonothiolate (agent VX), and vesicants including bis(2-chloroethyl) sulfide (mustard gas, agent H or agent HD), dichloro (2-chlorovinyl) arsine (Lewisite or agent L), bis(2(2-chloro ethylthio)ethyl)ester (agent T), or combinations of these or with other liquids. The G agents are phosphonofluoridate esters. The V-type chemical warfare nerve agents generally comprise methyl phosphonothiolates having an internal amino group. These include agent VX and O-isobutyl-S-(2-diethyl) ethyl methylphosphonothiolate, and O,S-diethyl methylphosphonothiolate. The phosphonothiolates form toxic hydrolysis products comprising phosphonothioic acids.

Experiments using the chemical agents Mustard, VX, and GD (pinacolyl methylphosphonofluoridate) showed that the oxidizer gel using potassium peroxymonosulfate as the oxidizer and fumed silica (15% Cab-o-sil™EH-5) as the gelling agent destroyed the chemical agents in the time it took the gel to go to dryness. This gel also totally destroyed the Anthrax simulant *Bacillus globigii* (BG).

The present oxidizer gels are relatively non-corrosive and lend themselves to simple delivery systems: simplex sprayers or air assisted sprayers, for example. Gels can be spray-coated onto a surface with a sprayer or applied by rollers or brushes. Because of the colloidal attraction between the gelling particles, more uniform coverage of the surfaces to be decontaminated is achieved. In addition, the gels may absorb certain chemical or biological agents, such as spores and cells, because of the surface characteristics of the gel. The oxidizer gels can be applied to and are effective on a variety of surfaces, including glass, wood, paper, cement, asphalt, metals, and synthetic materials such as fiberglass and carpeting. The gels present no environmental problems and can be applied to the ground (soil).

Decontamination times will vary, but typically are on the order of one to six hours. After oxidation and detoxification of the area is complete, the gel (wet or dry) may be cleaned off with a water wash, or with a solution such as hydrogen peroxide solution. If the decomposition products are hazardous, the rinse water may need to be removed by vacuum. Alternatively, the wet or dry gel can be removed by vacuum and disposed of appropriately, such as in a hazardous treatment facility. As the carrier solvent evaporates, the oxidizing agent and the decomposition products are trapped in a weak gel residue formed from the thickening agent (e.g., fumed silica). This residue can be vacuumed into a biohazard or hazardous waste container for further treatment or disposal if necessary. Although the gel material (e.g., amorphous silica, potassium sulfate) is not hazardous, the decomposition products may still be toxic to the environment.

The thickening and gelation of liquid systems by a gelling agents depend on several parameters, including type of solvent (water, organic), concentration of gelling agent, size of the particles (surface area), pH, temperature, aging time, and presence of additives. To evaluate colloidal gelling agents, five materials were first evaluated in water: fumed silicas from two manufacturers, precipitated silica, fumed alumina, and a mixture of silica and alumina. Table 1 lists the gelling agents evaluated and some properties from the manufacturers data sheets. The highest surface area materials are best for rheological control. Cab-o-sil™EH-5 (obtained from Cabot Corporation) has the largest surface area of the fumed silicas evaluated (380 $m^2$Ig). Aerosil™200 (obtained form Degussa Corporation) has intermediate surface area (200 $m^2$Ig). Precipitated silica (HiSil™T-700 from PPG industries) has larger primary particles (21 nm) and lower surface area (210 $m^2/g$) compared to the fumed silica. Precipitated silica is prepared by controlled neutralization of a sodium silicate solution; since it is formed by neutralization from base, it has a neutral pH. Fumed aluminum oxide (Aluminum Oxide C from Degussa Corporation) and a mixed oxide of silica and alumina (COK 84) have the lowest surface areas of the materials evaluated.

Fumed silica is produced by the vapor phase hydrolysis of silicon tetrachloride in a hydrogen oxygen flame. Three-dimensional branched chain aggregates of 0.2–0.3 $\mu$m are produced in the flame from fusion of the primary particles (7–40 nm). During cooling, these aggregates agglomerate into a fine powder of 44 $\mu$m or less. Trace analysis of metallic contaminants show ppm levels of Al, B, Ca, Ni, Fe, and Ti. Fumed silica is amorphous $SiO_2$ having a density of 2.20 g/cc. Hydroxyl groups (~4 groups/$nm^2$) attached to the surface of the fumed silica make it hydrophilic and capable of hydrogen bonding with suitable molecules in vapor, liquid or solid form. This ability is related to thickening of non-polar and semi-polar liquids. Increasing concentrations of fumed silica are typically required for gelation as the hydrogen bonding capability of the liquid increases.

TABLE 1

| Gelling agent (lot #s) | Particle size (nm) | Aggregate size ($\mu$m) | Surface area ($m^2/g$) | pH |
|---|---|---|---|---|
| Fumed Silica (Cab-o-sil ™ EH5) | 7 | 0.3 | 380 | 4 |
| Fumed Silica (Aerosil ™ 200) | 12 | 0.4 | 200 | 4 |
| Mixed Oxide Silica/Alumina (COK 84) | — | — | 170 | 4 |
| Fumed Alumina (Alumina C) | 13 | — | 100 | 5 |
| Precipitated Silica (HiSil ™ T700) | 21 | 1.9 | 210 | 7 |

The gelation characteristics of a particular gelling agent were evaluated in a stepwise fashion by adding a weighed amount of deionized water to a weighed amount of gelling agent. These mixtures were agitated for five minutes on a paint shaker. The resulting suspension was allowed to sit for five minutes and classified on a scale from 1 to 5 based on observed quality of the gel: 1 indicated watery liquid, 2 indicated thick liquid, 3–4 indicated gels of increasing integrity, and 5 indicated extremely viscous or dry gel. The gelling agent content was increased slowly until gelation occurred. FIG. 1 shows the results for each gelling agent.

In general, the viscosity increased gradually until the concentration of gelling agent was sufficient to form a network and the system gelled-weakly at first, then rapidly as the concentration of gelling agent increased. The fumed silica systems were difficult to disperse with a paint shaker as they neared gelling concentrations. These systems tended to aggregate in inhomogeneous "flocs" at around 12–13% by weight silica and crape harden with time. Mixtures of 13% or more silica that were fluid after shaking set up into very stiff gels when left overnight or for a few hours, which produced the variable ratings for the fumed silica samples shown in FIG. 1.

The precipitated silica has a slightly larger primary particle size and therefore slightly lower surface area. For this reason, it gels at higher concentrations than the fumed silica in water. Within the limits of these experiments, the precipitated silica did not show the inhomogeneous flocs or static behavior observed with fumed silica. The blend of $SiO_2$ and $Al_2O_3$ required the lowest concentration of gelling agent to produce aqueous gels (as low as 4–5%). Although the fumed alumina has a small particle size, it was the least effective gelling agent, indicating the importance of active sites on the colloid. Viable alumina gels required upwards of 25–27% by weight gelling agent. Colloidal mills or homogenizers may be used to produce gelling agent particles having the desired small size or more uniform size distribution.

Figure 2:
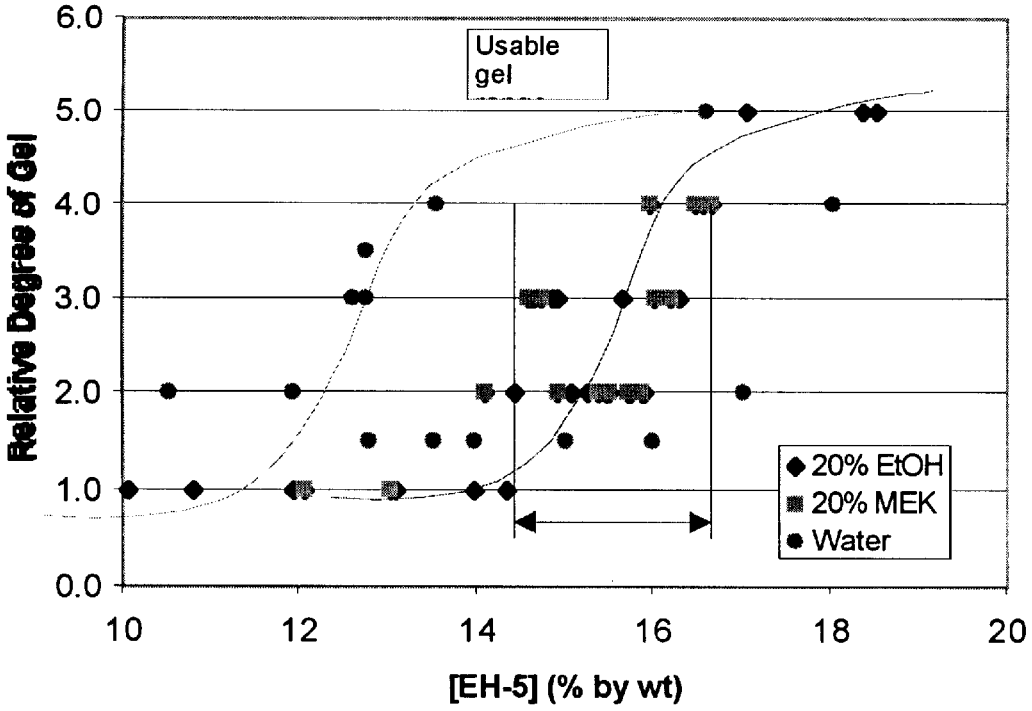
FIG. 2 shows the degree of gelation for fumed silica in water and organic solvents.

Mixed solvent systems were evaluated with fumed silica (EH-5). Two formulations, 20% solutions of methyl ethyl ketone and ethyl alcohol in water, were evaluated in the same manner described above. FIG. 2 shows the curves for degree of gelation as a function of concentration of fumed silica. The curves are shifted to higher concentrations for the 20% mixed solvent systems compared to water, but clearly they also form suitable gels. The mixed solvent gels were very similar. Moderately viscous gels formed from mixtures of 14.8–17.8% fumed silica in mixed solvent. These gels were comparable to gels formed from 12.8–14.8% fumed silica in water. Although mixed solvents were more readily dispersed by the paint shaker than water based gel, inhomogeneity of floc continued as indicated by the oscillations between viscous liquid and gel over the "usable gel" concentration range indicated by the bars and arrow in FIG. 2.

Figure 3:
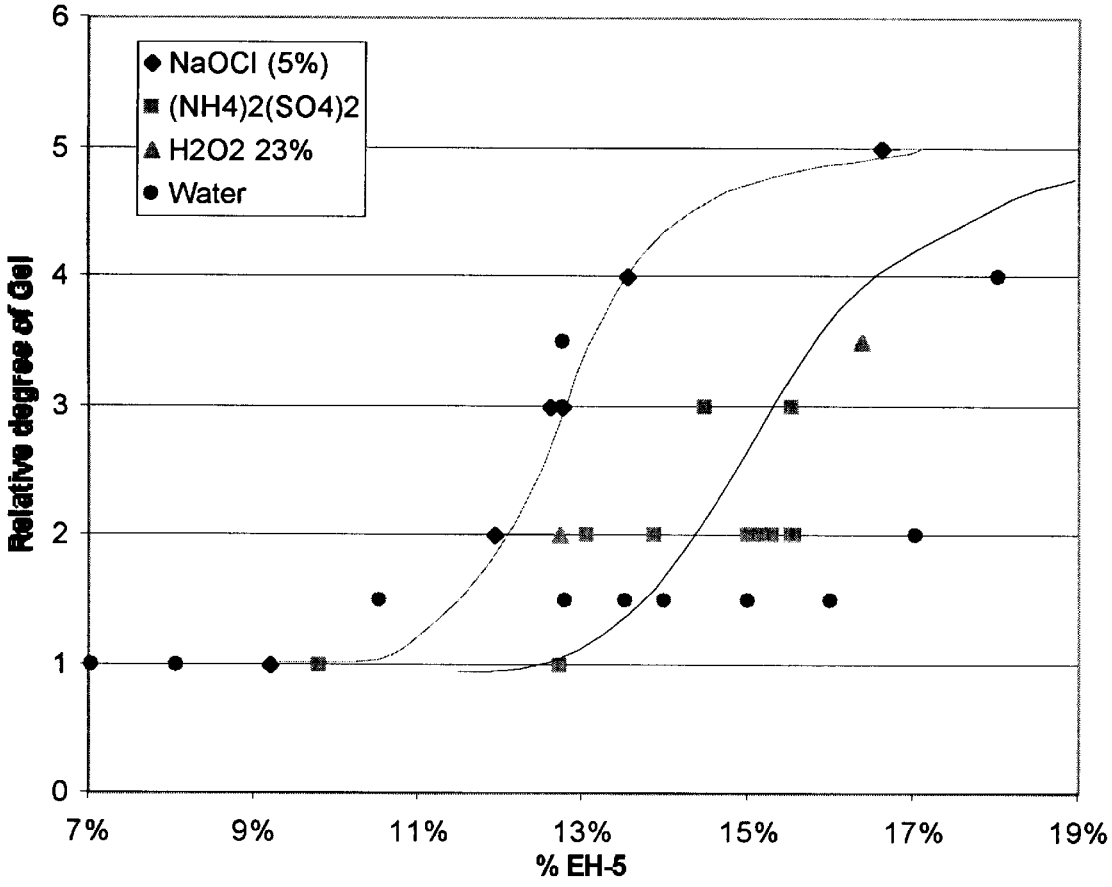
FIG. 3 shows the degree of gelation for fumed silica gel with various oxidizing agents.

The oxidizing agents listed in Table 2 for decontamination applications were gelled successfully with fumed silica (EH-5) as a gelling agent. Their gelation characteristics are shown in FIG. 3. The gels are similar to those generated without oxidizer, with persulfate and hydrogen peroxide requiring 3–4% increase in concentration of gelling agent compared to water. A 13.5% fumed silica (EH-5) gel made with 5.5% sodium hypochlorite in water was stored in a hood at ambient and in a refrigerator at 10° C. for several months without evidence of gas generation or other degradation. A 14.5% fumed silica (EH-5) gel of 0.3N-ammonium persulfate was stored in the refrigerator without obvious evidence of degradation. However, when a 16.4% fumed silica (EH-5) gel of 30% hydrogen peroxide was stored under these conditions, bubbles of oxygen were observed within a few days. Similar results occurred with a 5% mixed silica/alumina (COK-84) and 30% hydrogen peroxide gel.

TABLE 2

| Oxidizer (manufacturer) | % in solution | Normality | Formula Wt. |
|---|---|---|---|
| NaOCl (Clorox) | 5.5 | — | 74.44 |
| $(NH_4)_2(SO_4)_2$(Aldrich) | — | 0.3 N | 228.22 |
| $H_2O_2$ | 30 | 19.2 | 34.82 |

To evaluate the rheology of a gel and its spraying characteristics, the rheological characterization of water and oxidizer gels was performed on a Rheometrics™ mechanical spectrometer model 800 (using 2.54-cm diameter parallel plates separated by a 2.00-mm gap). The calculations for shear stress, shear rate, and shear modulus or viscosity in parallel plate fixtures are well-known in the art and need not be elaborated here. Results for the gels were obtained from oscillatory measurements where the amplitude of oscillation was varied.

The results for the dynamic viscosity of a 13.6% fumed silica (EH-5) gel are characteristic of moderately strong gels (values of 3–4 in FIGS. 1–3). The gels act as non-Newtonian fluids. When the amplitude of oscillation is small (1%), the network structure is not damaged, as it will be in steady shear. Because of the small oscillation, the shear storage modulus is nearly constant at ~7000 Pa, indicating the measurement is in the viscoelastic range for a solid. This is characteristic of a strong network structure in the gel.

The dynamic viscosities of three water/EH-5 gels and a 5% NaOCl/EH-5 gel were similar. Although the concentrations required to achieve the sodium hypochlorite gel were lower than those of the water gels, the results imply that the oxidizer solution will have similar viscoelastic behavior and will spray in a similar fashion to water gels with similar viscosity. Gels of fumed silica (EH-5) and ammonium persulfate or hydrogen peroxide also had dynamic viscosities consistent with fumed silica (EH-5) gels in water.

The strength of the network was evaluated by strain sweep measurements. When the amplitude of oscillation is increased from 0.05% to 5% or higher, the viscoelastic regime of the gel may be exceeded and the network completely destroyed. Three types of behavior were found in the gelling agents. When gels form at low (4–5%) concentration (e.g., COK 84), the network can be broken down at relatively low strain (1–2%). When the gels are weak, but require moderate to high concentrations of gelling agent (above 10%), breakdown occurs beyond the 5% strain range. When the gels are strong at moderate to high concentration of gelling agent, the networks are stable up to at least 5% strain. Fumed silica forms a denser network compared to precipitated silica, alumina, and a fumed blend of alumina and silica.

The choice of gelling agent and its concentration depend on the application of the gel. For example, for stiffer gels that can be applied to highly inclined or contoured surfaces, fumed silica in moderate to high concentrations may be used. Alternatively, if a more fluid gel is desired to apply to flat areas quickly or by spraying, then gelling agents at lower concentrations or with more alumina may be used. The hardening of the gel can also be a consideration. For example, fumed silica gels tend to harden with age. Mixtures of fumed silica (EH-5) above about 12.5% by weight that are fluid after shaking for five minutes will set up to very strong gels in 1–2 days. This complicates pre-mixed formulations since the viscosity increases dramatically over relatively short periods of time. In certain applications, however, a gel that hardens quickly may be desirable. The formulations can be made in the field immediately before application to the contaminated area.

Figure 4:
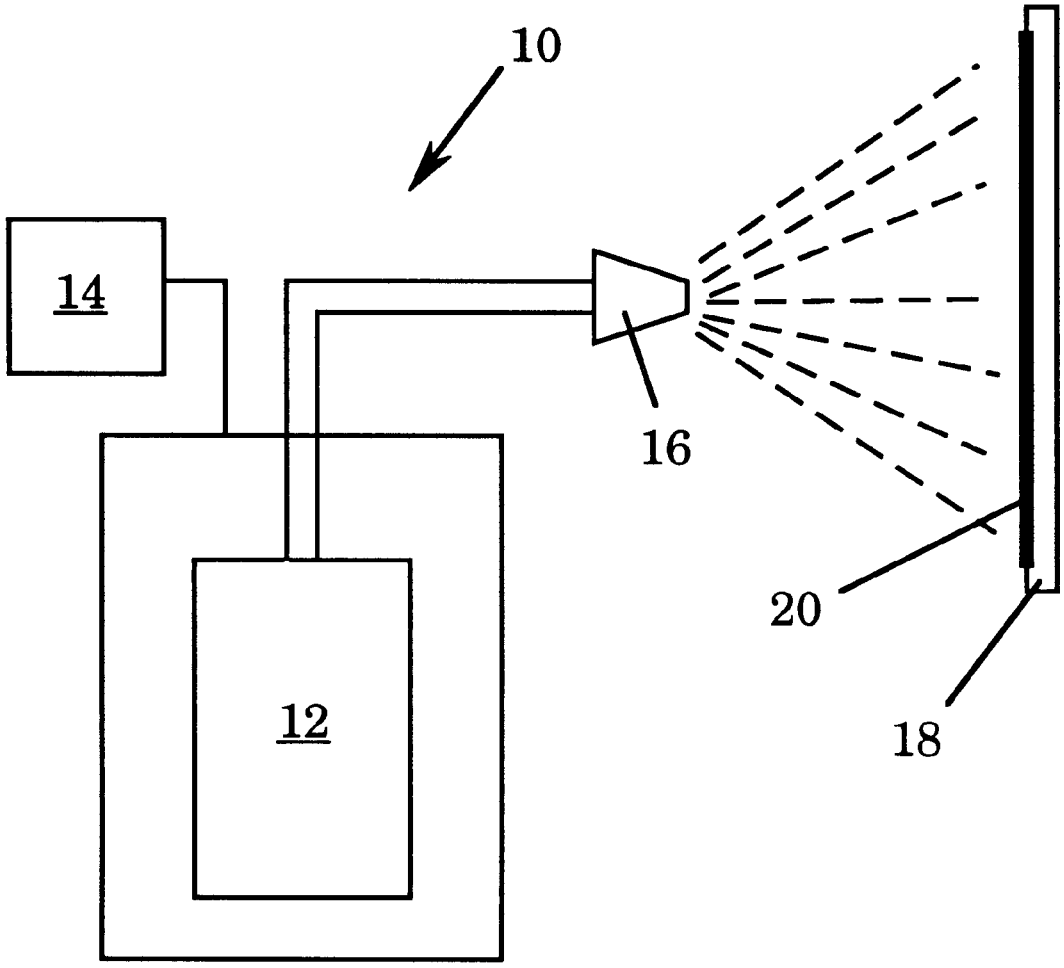
FIG. 4 is a schematic diagram of a sprayer for applying the oxidizer gel according to the present invention.

To verify the ability to spray the gels, a simplex sprayer was designed and built. A stainless steel vessel was constructed, approximately 18 cm high by 5.4 cm in diameter, which holds approximately 750 cc of fluid or gel. A Teflon sprayer nozzle was attached to the central tube using a standard pipe thread. Inside the central tube was a removable nine-element static mixer. The sprayer was attached to 100-psi house air by a regulator that controlled the pressure to ±2-psi. FIG. 4 shows a schematic diagram of the sprayer 10 with gel container 12, pressure regulator 14, nozzle 16, and a substrate 18 with a gel coating 20 on its surface. For larger volume applications, sprayers can be readily designed and scaled-up. Commercial paint sprayers have also been successfully used to dispense the gelled oxidizers.

Tests were performed with water and three gels with varying concentrations of fumed silica (EH-5) in water. The results are given in Table 3. The fluid was added to the sprayer, and the sprayer was positioned approximately 30.5 cm from a test panel surface (aluminum foil about 30.5×16.5 $cm^2$). The pressure in the sprayer was maintained at 40-psi. The nozzle was a standard fan type with spray angle of 90 degrees and a nominal flow rate of approximately 6 gal/min. The test panel was weighed before and after five seconds of spraying, with a one minute wait to allow for runoff before re-weighing the test panel to determine the extent of coverage.

TABLE 3

| Gelling agent | % agent by wt. | Weight/5 sec | Thickness | Remarks |
|---|---|---|---|---|
| None (water) | 0 | 4.3 g | 36 μm (1.4 mils) | runoff |
| Fumed $SiO_2$ (EH-5) | 12.8% | 15.2 g | 125 μm (4.9 mils) | 3.5 × water |

TABLE 3-continued

| Gelling agent | % agent by wt. | Weight/5 sec | Thickness | Remarks |
|---|---|---|---|---|
| Fumed $SiO_2$ | 18.0% | 0 | 0 | too thick |
| Fumed $SiO_2$ | 17.0% | 3.9 g | 33 $\mu$m (1.3 mil) | poor dispersion |

The 12.8% fumed silica gel was sprayed immediately after formulation. This gel produced a coating on the test panel that was 3.5 times thicker than water and adhered more uniformly. The 18% silica gel could not be sprayed in 100-g quantities because the gel would not flow down to the bottom of the sprayer. Reconstituting the 18% gel and adding water to make approximately 17% silica gel resulted in poor dispersion. Attempts to spray the reconstituted gel resulted in fluctuations in the sprayer cone angle and pressure at the nozzle. The tests showed that with the appropriate concentrations and spraying conditions, silica gels can uniformly apply 3.5 times more material to a surface than water.

The sprayers and nozzles can be designed (e.g., adjusting aperture size, flow rate) to optimize the spraying of oxidizer gels of varying viscosities and to achieve the desired coverage. For large scale applications, modified agricultural crop sprayers may be employed to broadcast the gel by plane or helicopter.

The foregoing description of preferred embodiments of the invention is presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the particular use contemplated.

What is claimed is:

1. A thixotropic composition consisting essentially of a gel, said gel consisting essentially of (1) a liquid oxidizer solution containing at least one oxidizing agent, and (2) a gelling agent containing at least one colloidal material having a primary particle size of 21 nm or smaller.

2. The composition recited in claim 1, wherein the gelling agent is selected from the group consisting of silica, alumina, aluminum silicon oxide, alumino-silicate clays, and mixtures thereof.

3. The composition recited in claim 2, wherein the silica is selected from the group consisting of fumed silica, precipitated silica, and mixtures thereof.

4. The composition recited in claim 1, wherein the oxidizing agent is selected from the group consisting of sodium hypochlorite, ammonium persulfate, ammonium peroxymonosulfate, peroxydisulfate, potassium permanganate, hydrogen peroxide, ozone, and potassium peroxymonosulfate.

5. The composition recited in claim 1, wherein said oxidizer solution contains water.

6. The composition recited in claim 1, wherein said oxidizer solution contains an organic solvent.

7. The composition recited in claim 1, wherein said gel has a viscosity greater than water.

8. The composition recited in claim 1, wherein said gel has a viscosity at least three times greater than water.

9. The composition recited in claim 1, wherein the gelling agent has a concentration in the range from about 3% to about 30% by weight.

10. The composition recited in claim 1, wherein the gelling agent has a concentration in the range from about 3% to about 20% by weight.

11. The composition recited in claim 1, wherein the gelling agent has a concentration in the range from about 5% to about 15% by weight.

12. The composition recited in claim 1, wherein the gel is acidic, having a pH of less than about 3.

13. The composition recited in claim 1, wherein the gel is basic, having a pH of greater than about 12.

14. A thixotropic composition consisting essentially of a gel, said gel consisting essentially of (1) a liquid oxidizer solution containing at least one oxidizing agent, (2) a gelling agent containing at least one colloidal material having a primary particle size of 21 nm or smaller. and (3) an oxidation catalyst.

15. The composition recited in claim 4, wherein said oxidation catalyst comprises contains metal ions.

16. A thixotropic composition consisting essentially of a gel having a viscosity greater than water, said gel consisting essentially of (1) a liquid oxidizer solution containing at least one oxidizing agent, and (2) a gelling agent containing at least one colloidal material having a primary particle size of 21 nm or smaller, said gelling agent having a concentration in the range from about 5% to about 15% by weight.

17. The composition recited in claim 16, wherein the gelling agent is fumed silica.

18. The composition recited in claim 16, wherein the oxidizing agent is potassium peroxymonosulfate.

19. A method for detoxifying an area exposed to chemical or biological agents, comprising the steps of:

applying a gel, said gel comprising (1) a liquid oxidizer solution containing at least one oxidizing agent, and (2) a gelling agent containing at least one colloidal material having a primary particle size of 21 nm or smaller to the area, allowing the gel to detoxify the area, allowing the gel to dry after detoxification of the chemical or biological agents; and removing the gel from the area after detoxification of the chemical or biological agents.

20. The method recited in claim 19, wherein applying the gel comprises spraying the gel on the area.

21. The method recited in claim 19, wherein applying the gel comprises spreading the gel on the area.

22. The method recited in claim 19, wherein removing the gel comprises vacuuming.

23. The method recited in claim 19, wherein removing the gel comprises rinsing the area with a solvent.

* * * * *